US007168580B2

(12) United States Patent
Larimer et al.

(10) Patent No.: US 7,168,580 B2
(45) Date of Patent: Jan. 30, 2007

(54) RACK

(75) Inventors: Robert Larimer, New York, NY (US); Edward Kilduff, New York, NY (US)

(73) Assignee: MetroKane, Inc., New York, NY (US)

( * ) Notice: Subject to any disclaimer, the term of this patent is extended or adjusted under 35 U.S.C. 154(b) by 189 days.

(21) Appl. No.: 10/839,705

(22) Filed: May 6, 2004

(65) Prior Publication Data

US 2005/0247655 A1 Nov. 10, 2005

(51) Int. Cl.
*A47B 43/00* (2006.01)

(52) U.S. Cl. ..... 211/200; 211/74; 211/195; 211/201; 211/181.1; 211/85; 248/431

(58) Field of Classification Search ..... 211/200, 211/74, 195, 201, 181.1, 85, 85.31, 202, 105; 248/164, 431, 166, 188.6, 188.8; 108/118; 160/135, 229.1; 446/85, 124, 126; 52/646
See application file for complete search history.

(56) References Cited

U.S. PATENT DOCUMENTS

| | | | | | |
|---|---|---|---|---|---|
| 63,383 | A * | 4/1867 | Hanks | 248/97 |
| 813,699 | A * | 2/1906 | Harrover | 217/19 |
| 1,113,573 | A * | 10/1914 | Dotman | 297/52 |
| 1,209,679 | A * | 12/1916 | Decker | 5/116 |
| 2,990,788 | A * | 7/1961 | Wallace | 104/126 |
| 3,175,650 | A * | 3/1965 | Wohlfort et al. | 52/646 |
| 3,221,837 | A * | 12/1965 | Fisher | 182/115 |
| 3,365,209 | A * | 1/1968 | Fischer | 280/20 |
| 3,502,291 | A * | 3/1970 | Ackerman et al. | 248/97 |
| 4,112,855 | A * | 9/1978 | Colby | 108/159 |
| 4,122,780 | A * | 10/1978 | Brickman | 108/25 |
| 4,471,548 | A * | 9/1984 | Goudie | 40/610 |
| 4,705,247 | A * | 11/1987 | Delmerico | 248/98 |
| 4,927,674 | A * | 5/1990 | Smith | 428/11 |
| 5,351,843 | A * | 10/1994 | Wichman et al. | 211/195 |
| 5,947,305 | A * | 9/1999 | Lin | 211/74 |
| 6,722,618 | B1 * | 4/2004 | Wu | 248/166 |
| 2003/0080073 | A1 * | 5/2003 | Huang et al. | 211/40 |

* cited by examiner

*Primary Examiner*—Richard E. Chilcot, Jr.
*Assistant Examiner*—Lindsay M. Maguire

(57) ABSTRACT

A first section of a rack includes a first lower wire bend, a second lower wire bend, a first upper wire bend, and a second upper wire bend. The first section also includes a first pivot coupling into which is received a first end of each of the first and second lower wire bends and into which is received a first end of each of the first and second upper wire bends. The first section also includes a second pivot coupling into which is received a second end of each of the first and second lower wire bends and into which is received a second end of each of the first and second upper wire bends.

6 Claims, 13 Drawing Sheets

RACK

BACKGROUND OF THE INVENTION

1. Field of the Invention

The present invention relates to collapsible and re-expandable modular racks. In particular, the invention relates to modular wine racks and methods to make such racks.

2. Description of Related Art

Wine racks have been known for years. However, most wine stores, particularly smaller stores, do not sell wine racks. Wine racks take up too much retail space to be worth the shelf space in a wine store. What is needed is a collapsible and re-expandable wine rack that can be collapsed for shipment and storage in compact form and then expanded for display in the wine store. Then, the wine store would only need to display one or two expanded wine racks since additional racks could be easily expanded as the display models are sold.

Life Style Products of Vermont sells a 12 bottle wine rack that has wooden rails and dowels inserted in bores in the wooden rails. The dowels are inserted in the rails to assemble a rack to various sizes. However, this rack must be disassembled, piece by piece, for compact storage.

Stackable modular wine racks are known. FIG. 16 illustrates a known wine rack assembled from individual bottle holder modules. These individual modules have been assembled into a 12 bottle rack. However, known modular wine racks are not collapsible and re-expandable. There remains a need for expandable and modular wine racks. In particular, there remains a need for an expandable and modular wine rack so that a wine store could display only the smaller formats, for example a 4, 6, 9 or 12 bottle expandable wine rack, but still assemble the a larger format, for example 16, 24, 36 and 48 bottle expandable wine racks, from the modular expandable smaller formats. For example, there is a need for an expandable modular wine rack such that the wine store, or the customer, could expand several, for example four, smaller expandable racks, for example four 6bottle wine racks, such as might be displayed in the wine store, and then modularly combine the smaller format wine racks into a larger format wine rack, for example a 24 bottle wine rack.

SUMMARY OF THE INVENTION

The invention improves the state of the art by providing an expandable modular rack A first section of the rack, according to an embodiment of the invention, includes a first lower wire bend, a second lower wire bend, a first upper wire bend, and a second upper wire bend. The first section also includes a first pivot coupling into which is received a first end of each of the first and second lower wire bends and into which is received a first end of each of the first and second upper wire bends. The first section also includes a second pivot coupling into which is received a second end of each of the first and second lower wire bends and into which is received a second end of each of the first and second upper wire bends.

In another embodiment of the invention, a method of making a rack includes bending wire, forming a first frame, forming a complementary frame locating the first frame inside of the complementary frame, and inserting first and second pivotal connectors. The bending of wire bends wire into a first lower wire bend, a second lower wire bend, a first upper wire bend and a second upper wire bend. The forming of the first frame includes inserting ends of the first lower wire bend and the second upper wire bend into first and second molds and insert molding the ends into first and second coupling parts. The forming of the complementary frame includes inserting ends of the second lower wire bend and the first upper wire bend into third and fourth molds and insert molding the ends into third and fourth coupling parts. The inserting of pivotal connectors includes inserting a first pivotal connector through apertures in the first and third coupling parts and inserting a second pivotal connector through apertures in the second and fourth coupling parts.

BRIEF DESCRIPTION OF DRAWINGS

The invention will be described in detail in the following description of preferred embodiments with reference to the following figures wherein.

DETAILED DESCRIPTION OF PREFERRED EMBODIMENTS

Figure 1:
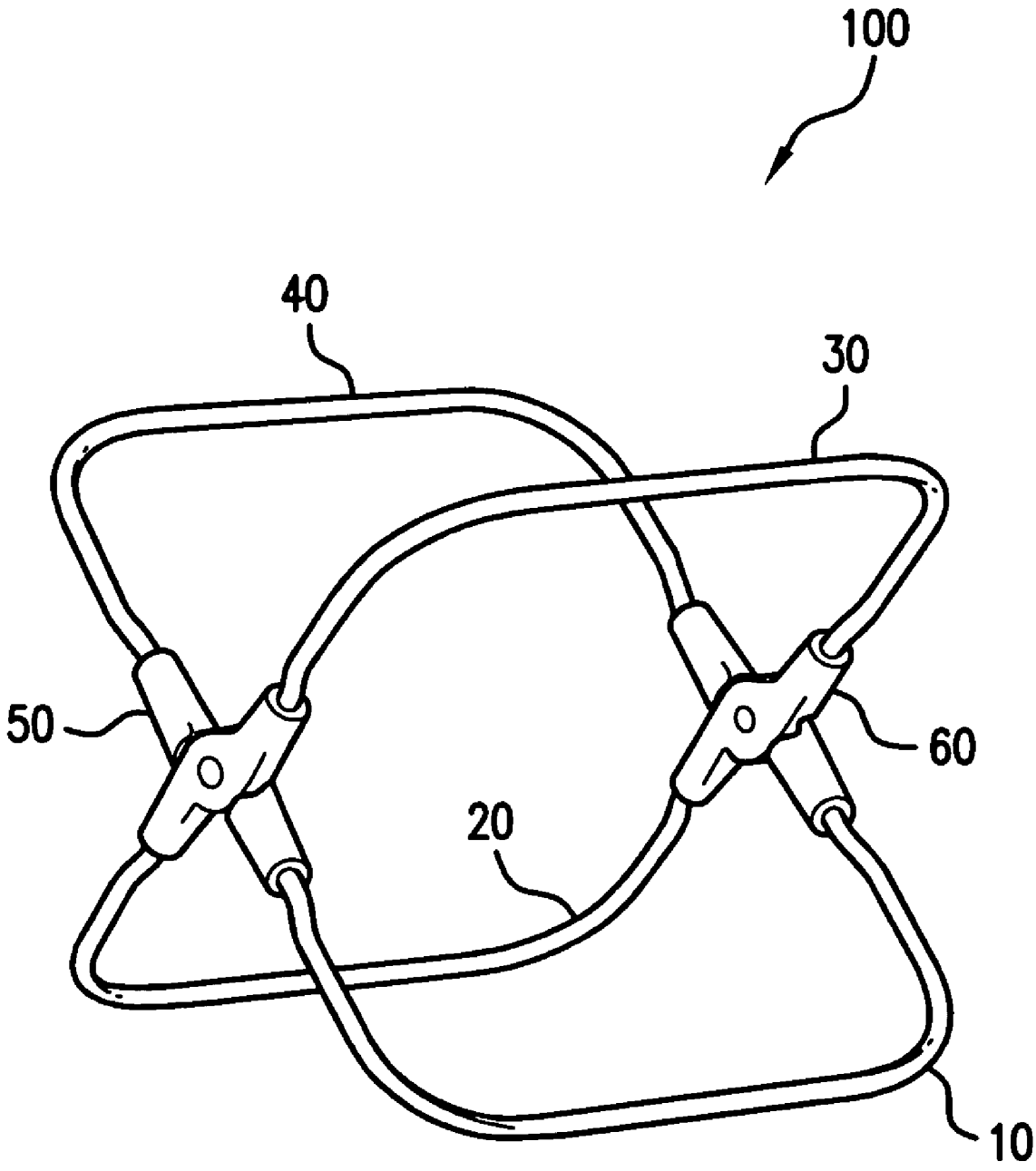
FIG. 1 is a perspective view of an exemplary section of a rack according to an embodiment of the invention.

In FIG. 1, an example of a rack, according to the invention, includes a first section. The first section includes a first lower wire bend 10, a second lower wire bend 20, a first upper wire bend 30, and a second upper wire bend 40. The first section further includes a first pivot coupling 50 and a second pivot coupling 60. A first end 12 of each of the first and second lower wire bends and each of the first and second upper wire bends is received in the first pivot coupling 50. A second end 14 of each of the first and second lower wire bends and each of the first and second upper wire bends is received in the second pivot coupling 60.

Figure 2:
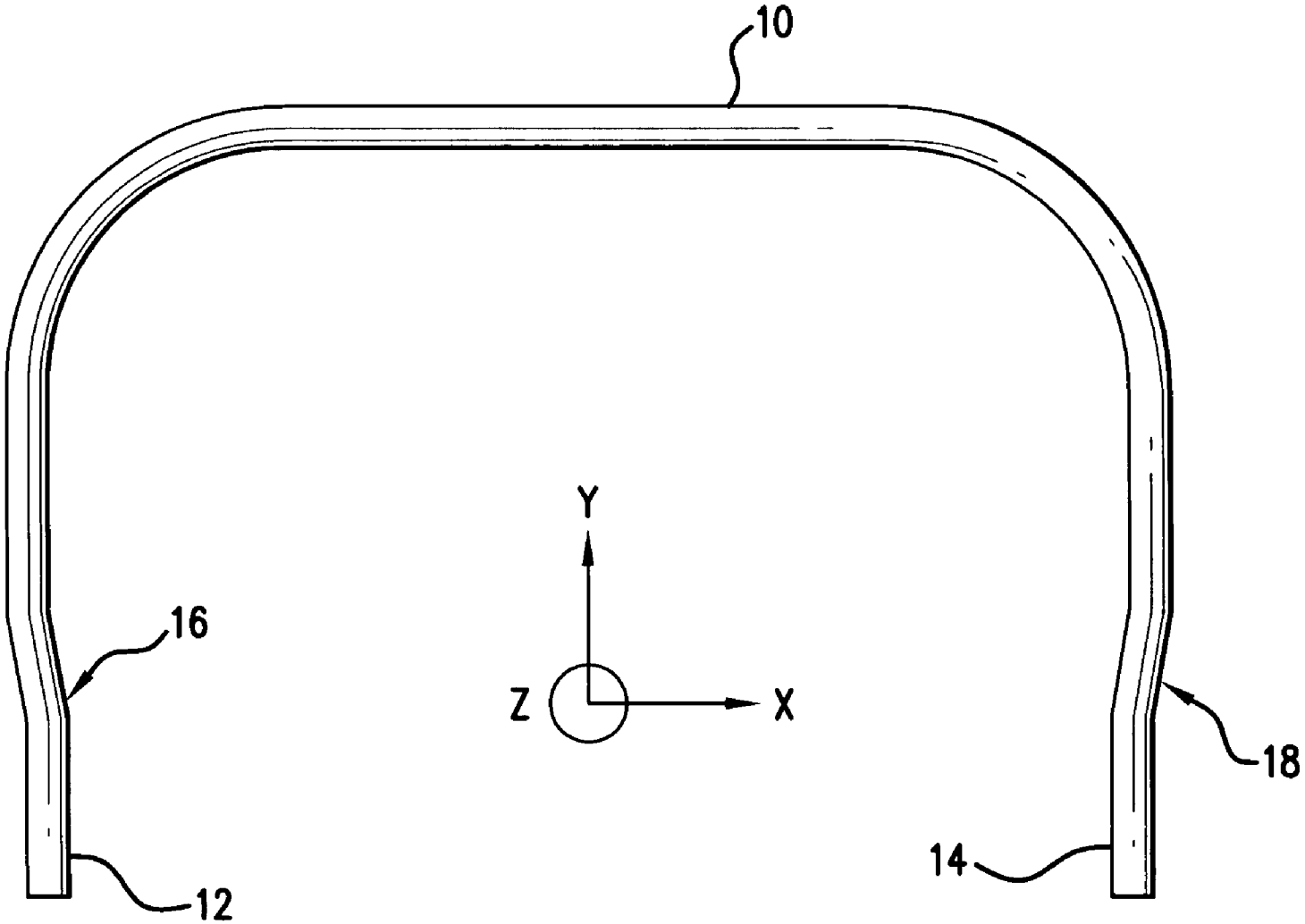
FIG. 2 is a plan view of a wire bend according to an embodiment of the invention.

FIG. 2 depicts a typical wire bend 10 with first end 12 and second end 14 in a plane defined in by X, Y axes. The wire bend is generally in the shape of a letter "C" and is formed of metal wire, for example steel. The metal wire may be, but need not be, chrome plated, power coated or painted. As used herein, the term "wire bend" may also include an element of similar form, fit and function (as described herein) made of any suitable material. For example, a resilient plastic that is formed into the described shape may be designed to have a similar form, fit and function.

Figure 4:
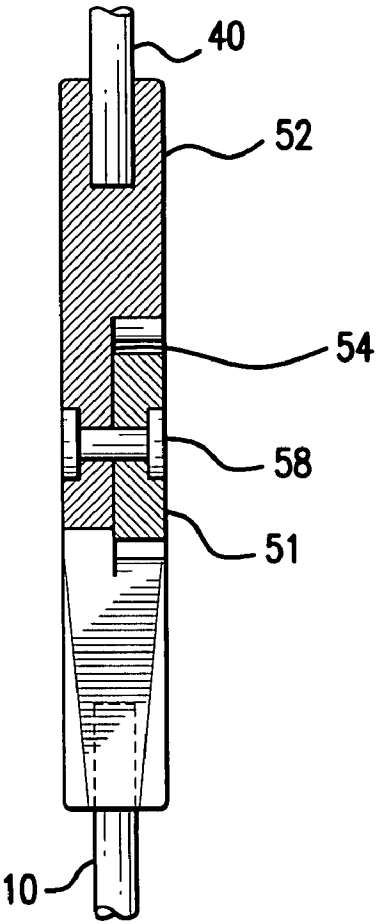
FIG. 4 is a sectional view of the pivot coupling of FIG. 3.
Figure 3:
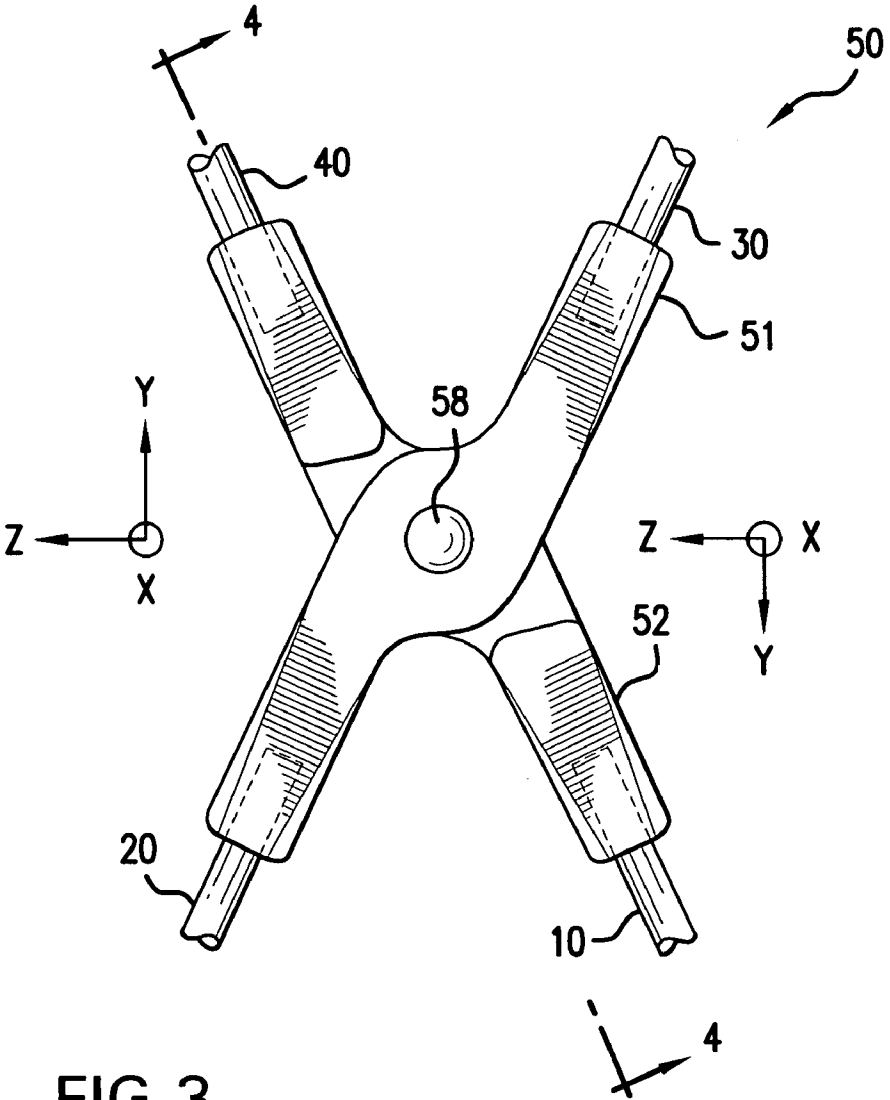
FIG. 3 is a side view of a pivot coupling according to an embodiment of the invention.

FIG. 3 depicts an example of a pivot coupling, e.g., pivot coupling 50 viewed from a direction orthogonal to a plane defined by the Y, Z axes. Pivot coupling 50 is formed from first coupling part 51, second coupling part 52, and pivotal connector 58. Pivotal connector 58 may be a rivet made of metal or plastic, a nut and bolt or any equivalent. FIG. 4 depicts a sectional view of pivot coupling 50 taken through sectional line 4—4 of FIG. 3. Each of the first and second coupling parts 51, 52 preferably include a thinned portion 54, as depicted in FIG. 4, to form a half-lapped pivotal connection between coupling parts 51, 52.

Figure 5:
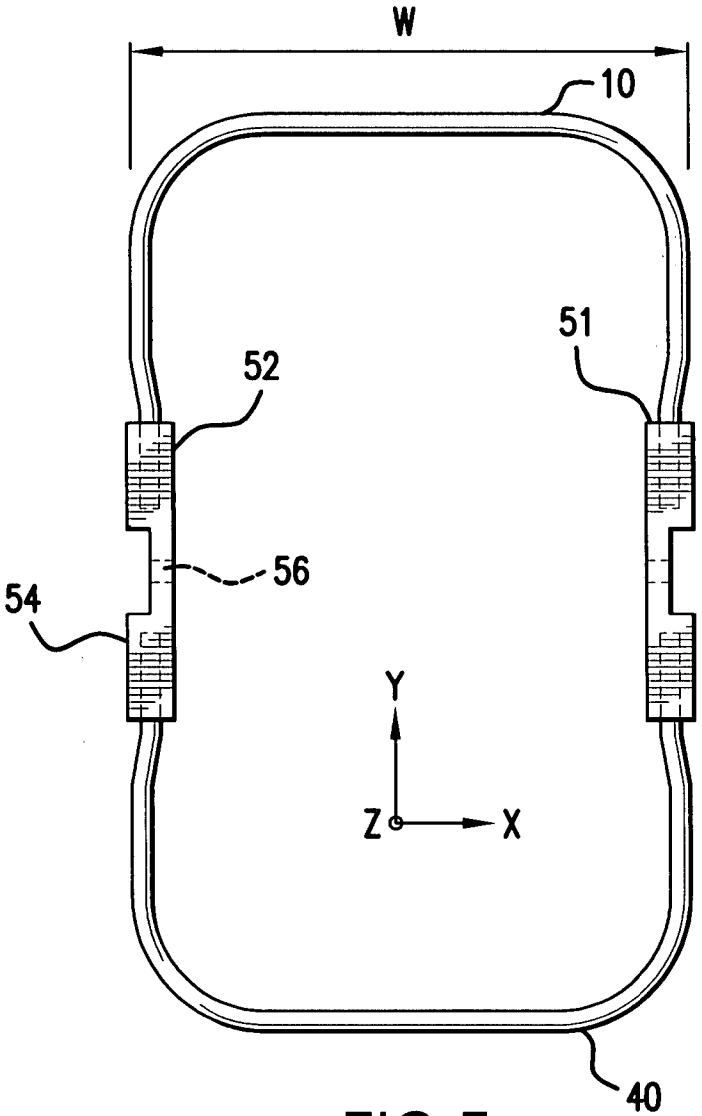
FIG. 5 is a front view of a frame that includes two wire bends and two coupling parts according to an embodiment of the invention.

FIG. 5 depicts a frame comprised of two wire bends 10, 40 and two coupling parts 51, 52. FIG. 5 illustrates how the first end 12, of each of wire bends 10 and 40, is anchored in second coupling part 52 of pivot coupling 50 as viewed from a direction orthogonal to a plane defined by the X, Y axes. Second coupling part 52, in this example, is formed out of an injection molded plastic, preferably nylon, but not necessarily nylon. The first ends 12 are placed in a mold and plastic is injected into the mold to surround the wire ends to form coupling part 52 with the wire ends permanently anchored in coupling part 52 in a process often called "insert-molded." The second end 14, of each of wire bends 10 and 40, is similarly anchored in a coupling part 51 of pivot coupling 60. This completes the frame, depicted in FIG. 5, that constitutes a partial section of the rack that is depicted in FIG. 1.

In another example, the wire ends 12 and 14 may be bent or upset by stamping (if metal) or upset thermally (if made of a thermally formed plastic) before the insert-molding process to better anchor the wire ends in the molded coupling parts.

Figure 7:
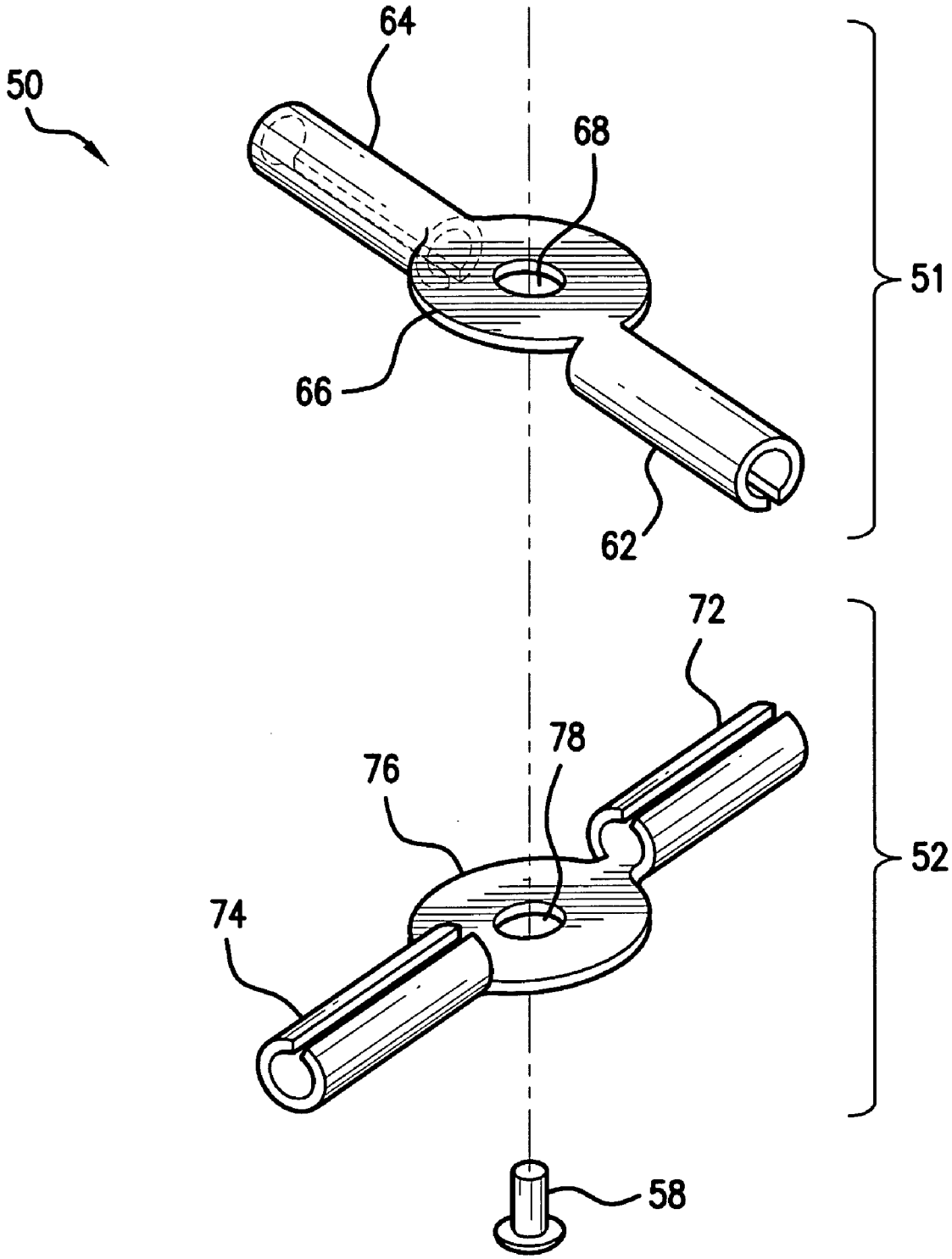
FIG. 7 is an exploded view of an alternative pivot coupling according to another embodiment of the invention.

In yet another example, the coupling parts, e.g., 51 and 52, are formed of metal. In FIG. 7, pivot coupling 50 is formed of first coupling part 51, second coupling part 52 and pivotal connector 58. First coupling part 51 includes a thin portion 66 through which aperture 68 has been formed and two metal ends 62 and 64 able to be crimped. Similarly, second coupling part 52 includes a thin portion 76 through which aperture 78 has been formed and two metal ends 72 and 74 able to be crimped. During assembly, wire ends 12 and 14 are inserted in metal ends 62, 64, 72 and 74 and the metal ends of the coupling parts are crimped.

In the example of the wire bend depicted in FIG. 2, the wire bend is formed with offset bends 16 and 18. However, other embodiments of the rack may use wire bends without such offset bends. However, an advantage of the offset bends is that a maximum area inside the wire bend is achieved without the pivot couplings 50 and 60 being forced to extend beyond the width W of the wire bends that constitute the frame as depicted in FIG. 5.

Figure 6:
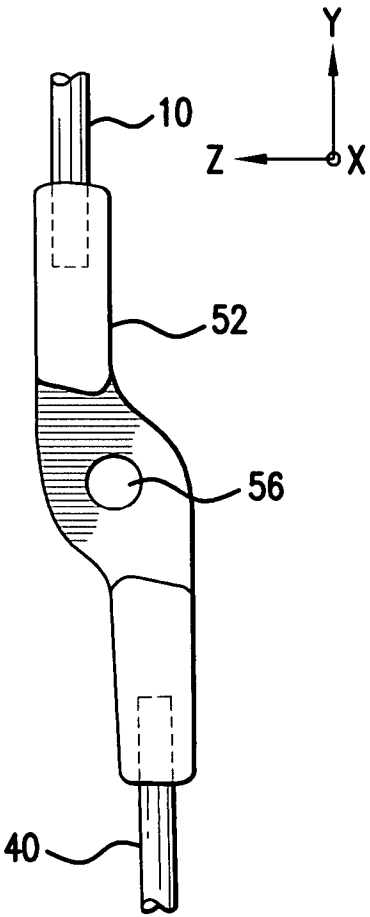
FIG. 6 is a side view of the frame of FIG. 5.

In another example, as depicted in FIG. 6 and as viewed from a direction orthogonal to a plane defined by the Y, Z axes, wire bends 10 and 40 are bent at their ends 12, 14 in a direction out of the X, Y plane so that coupling part 52 lies transverse to the X, Y plane. This will help facilitate folding the rack for storage or shipment as described more fully below.

In FIG. 5, the frame includes wire bends 10 and 40 and two coupling parts that have thinned portions disposed toward the center of the frame. A complementary frame (not illustrated) includes wire bends 20 and 30 and two coupling parts that have thinned portions disposed toward the outside of the frame. The two complementary frames are assembled together with the complementary thinned portions are disposed adjacent to each other before being fastened together with pivotal connections 58 to produce the section 100 of the rack illustrated in FIG. 1. Section 100 provides a basic building unit for making larger rack in a modular way.

Figure 8:
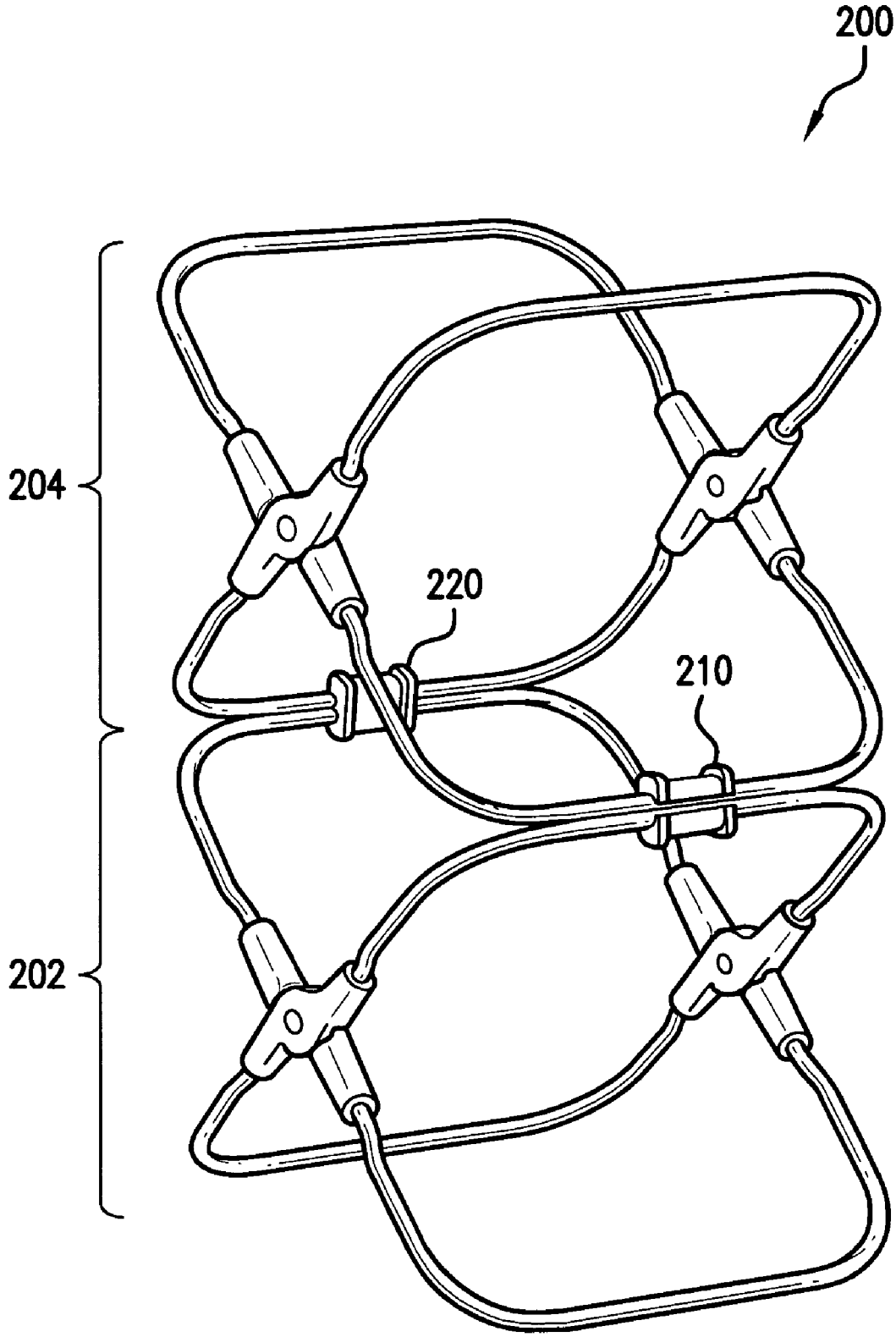
FIG. 8 is a perspective view of an exemplary rack with two modular sections arranged vertically according to an embodiment of the invention.

In FIG. 8, another example of the rack 200, according to the invention, includes first section 202 and second section 204. Each section is constructed according to any of the above described embodiments and examples. The example of the rack depicted in FIG. 8 further includes a first resilient clip 210 to hold the first lower wire bend of the second section to the first upper wire bend of the first section and a second resilient clip 220 to hold the second lower wire bend of the second section to the second upper wire bend of the first section.

Figure 9:
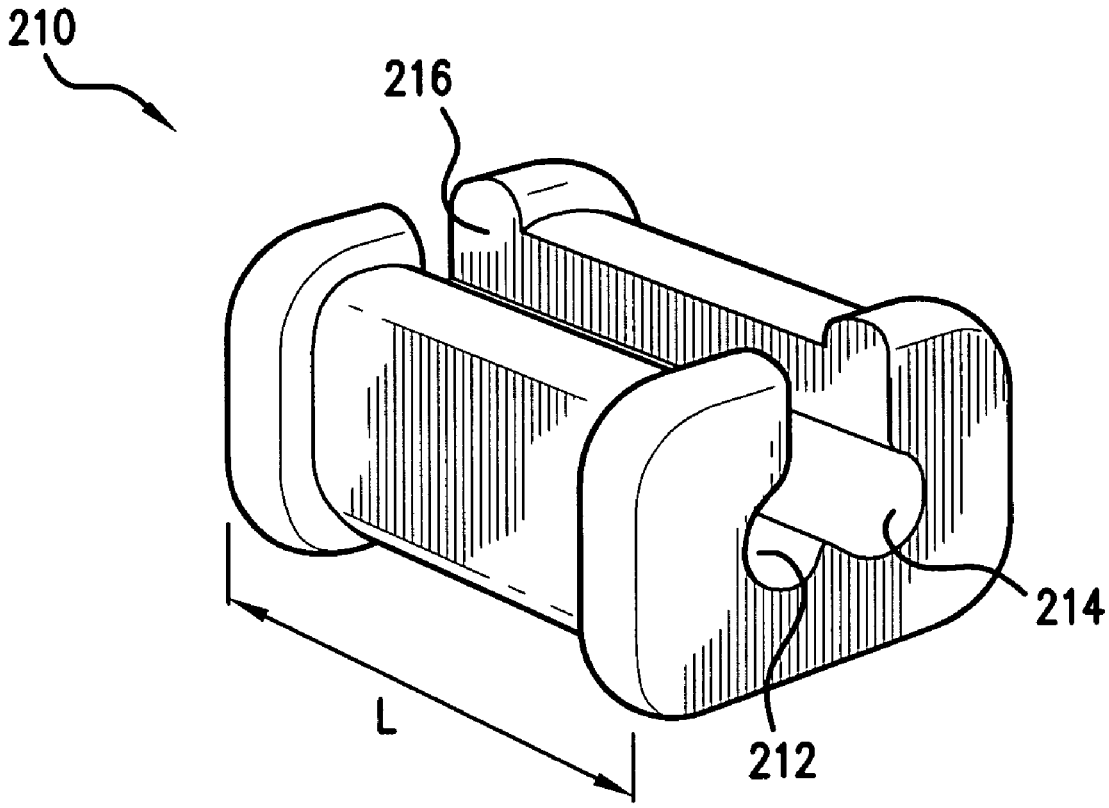
FIG. 9 is a perspective view of a resilient clip according to an embodiment of the invention.
Figure 10:
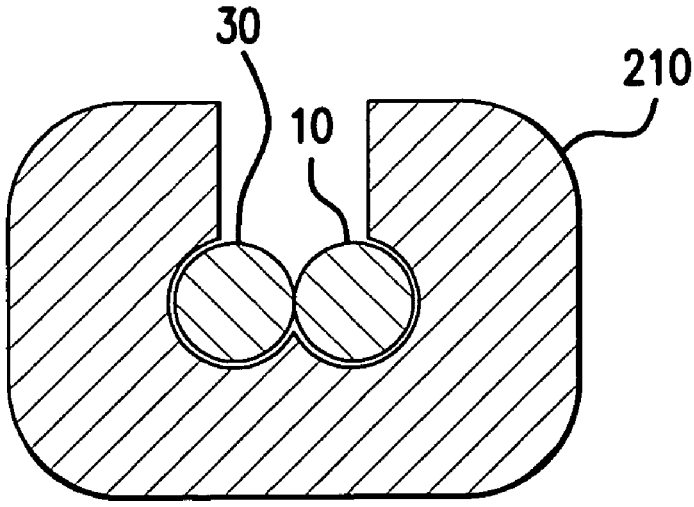
FIG. 10 is a sectional view of the clip of FIG. 9.

In FIG. 9, resilient clip 210 includes two channels 212 and 214 sized hold a wire bend and a gap 216 sized to permit a wire bend to be urged through the gap into either one of the channels 212, 214. FIG. 10 depicts a cross section of the clip 210 with wire bends 10 and 30 seated in their respective channels. However, it is not necessary that clip 210 be formed with a cross section shape that allows the channels to conform to the cross section shapes of the wires. The clip 210 may provide a single oval shaped channel sufficient to hold two wire bends 10, 30. The clip is formed of resilient material and the gap is sized so that when both wire bends are in the channel, neither wire bend is free to escape without sufficient force being applied to overcome a resilient resisting force. Thus, the clips hold the two wire bends. The resilient clips are made of a suitable resilient material. In an example, the clips are made of a resilient plastic co-molded with a rubber outside.

By using these resilient clips, any number of modular sections may be combined into a modular rack by snapping multiple wire bends together with such clips.

Figure 11:
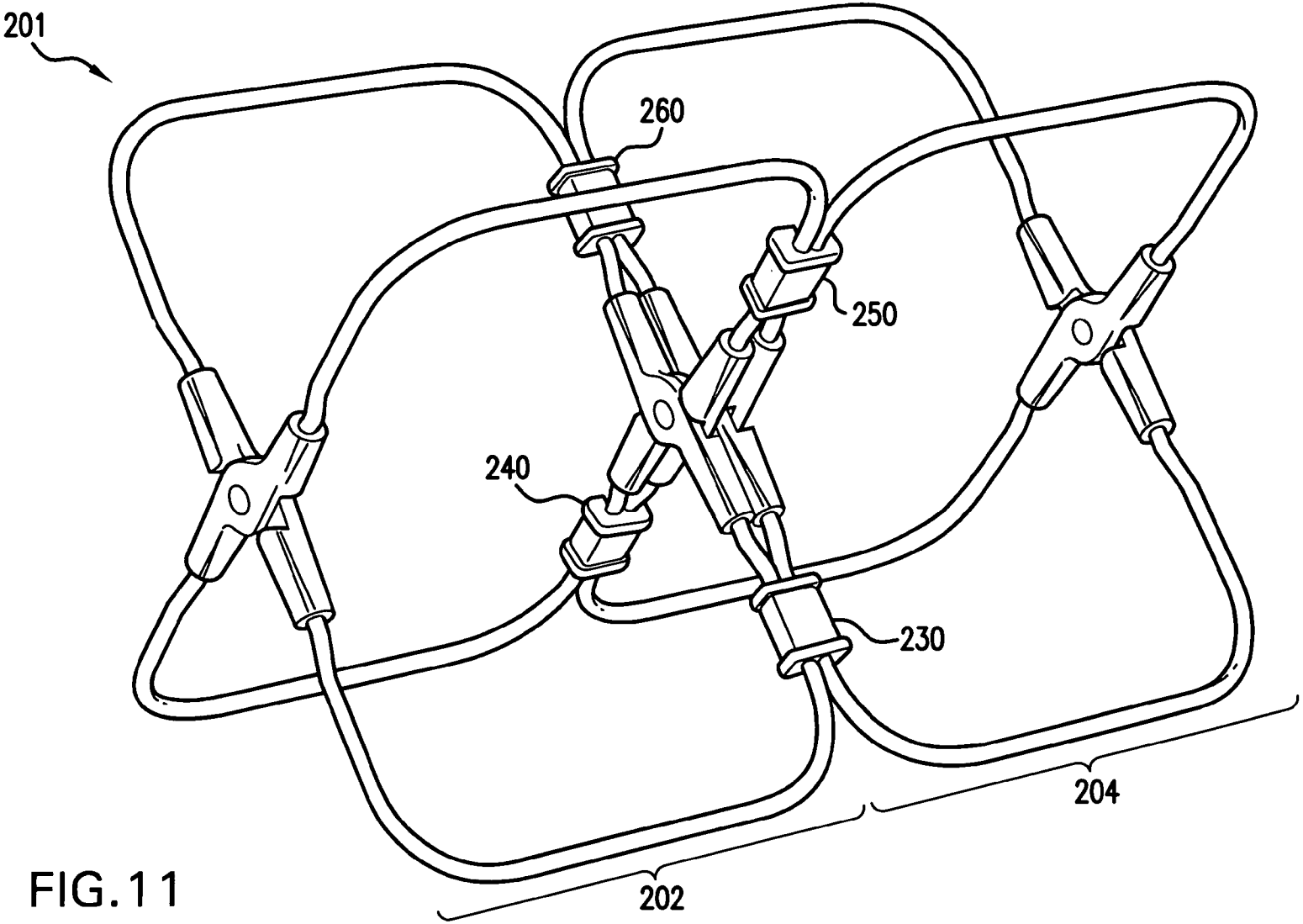
FIG. 11 is a perspective view of an exemplary rack with two modular sections arranged side by side according to an embodiment of the invention.

In FIG. 11, another example of a rack 201, according to the invention, includes first section 202 and second section 204. Each section is constructed according to any of the embodiments and examples discussed above with respect to FIGS. 1–7. The example of the rack depicted in FIG. 11 further includes a first resilient clip 230 to hold the first lower wire bend of the first section to the first lower wire bend of the second section, a second resilient clip 240 to hold the second lower wire bend of the first section to the second lower wire bend of the second section, a third resilient clip 250 to hold the first upper wire bend of the first section to the first upper wire bend of the second section, and a fourth resilient clip 260 to hold the second upper wire bend of the first section to the second upper bend of the second section.

Figure 12:
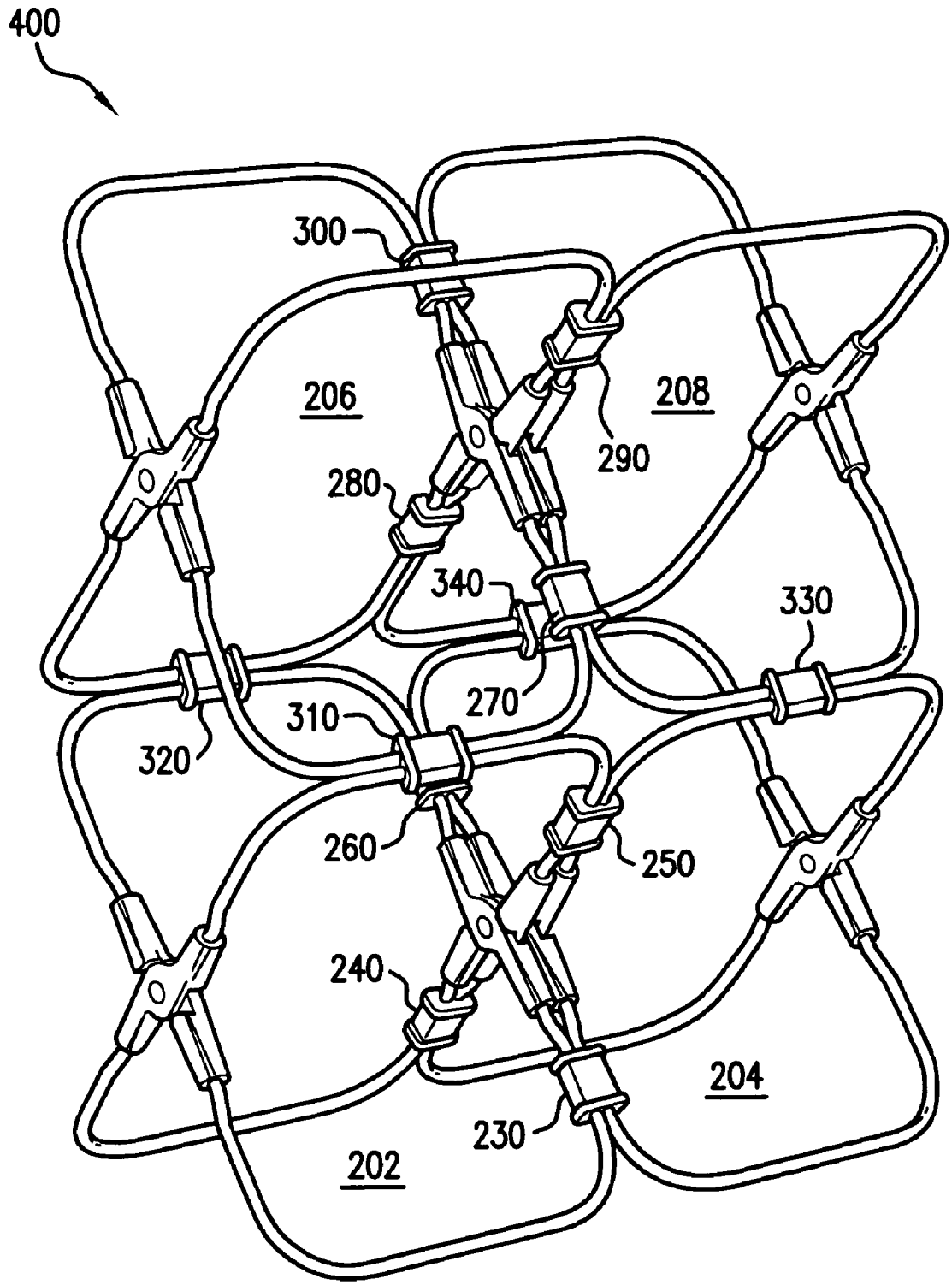
FIG. 12 is a perspective view of a fully open exemplary rack with four modular sections arranged in a two by two array according to an embodiment of the invention.
Figure 13:
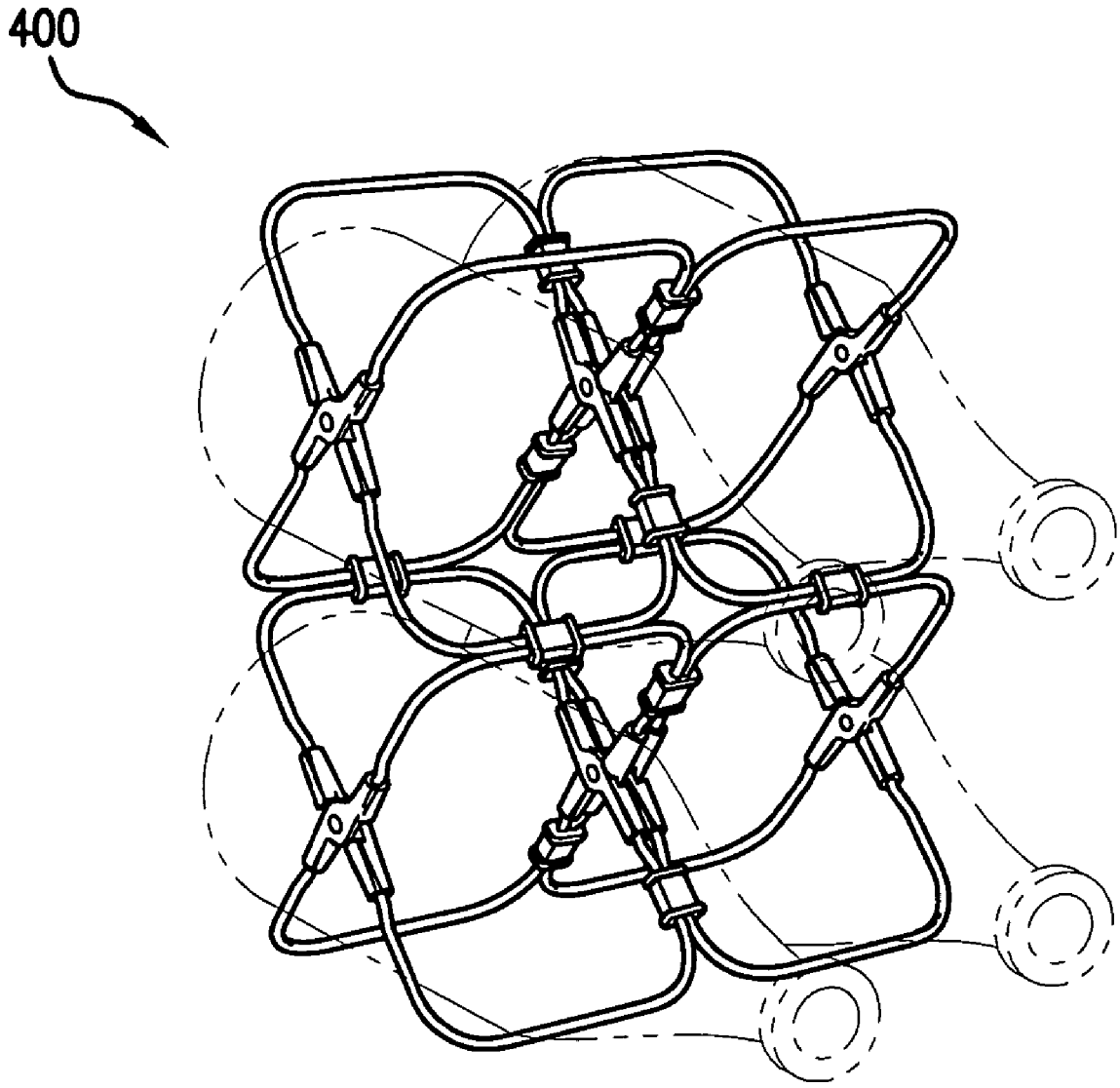
FIG. 13 is a perspective view of the fully open exemplary rack of FIG. 12 with four bottles stored thereon.

By combining the techniques for stacking sections vertically, e.g., FIG. 8, and attaching sections horizontally, e.g., FIG. 11, a rack with any number of sections may be produced. In FIG. 12, rack 400 with four sections in a 2 by 2 arrangement is illustrated. Beginning with the two-section horizontal rack 201 with the two sections attached with clips 230, 240, 250 and 260 and as depicted in FIG. 11, a second two-section horizontal rack is formed from sections 206 and 208 with the two sections being attached together with clips 270, 280, 290 and 300. Then, the second two-section horizontal rack is attached to the rack 201 with clips 310, 320, 330 and 340. Resilient clip 310 holds the first lower wire bend of the third section to the first upper wire bend of the first section. Resilient clip 320 holds the second lower wire bend of the third section to the second upper wire bend of the first section. Resilient clip 330 holds the first lower wire bend of the fourth section to the first upper wire bend of the second section. Resilient clip 340 to hold the second lower wire bend of the fourth section to the second upper wire bend of the second section. FIG. 13 depicts one of the many uses of modular rack 400, in this case, rack 400 is used to store wine bottles.

Figure 14:
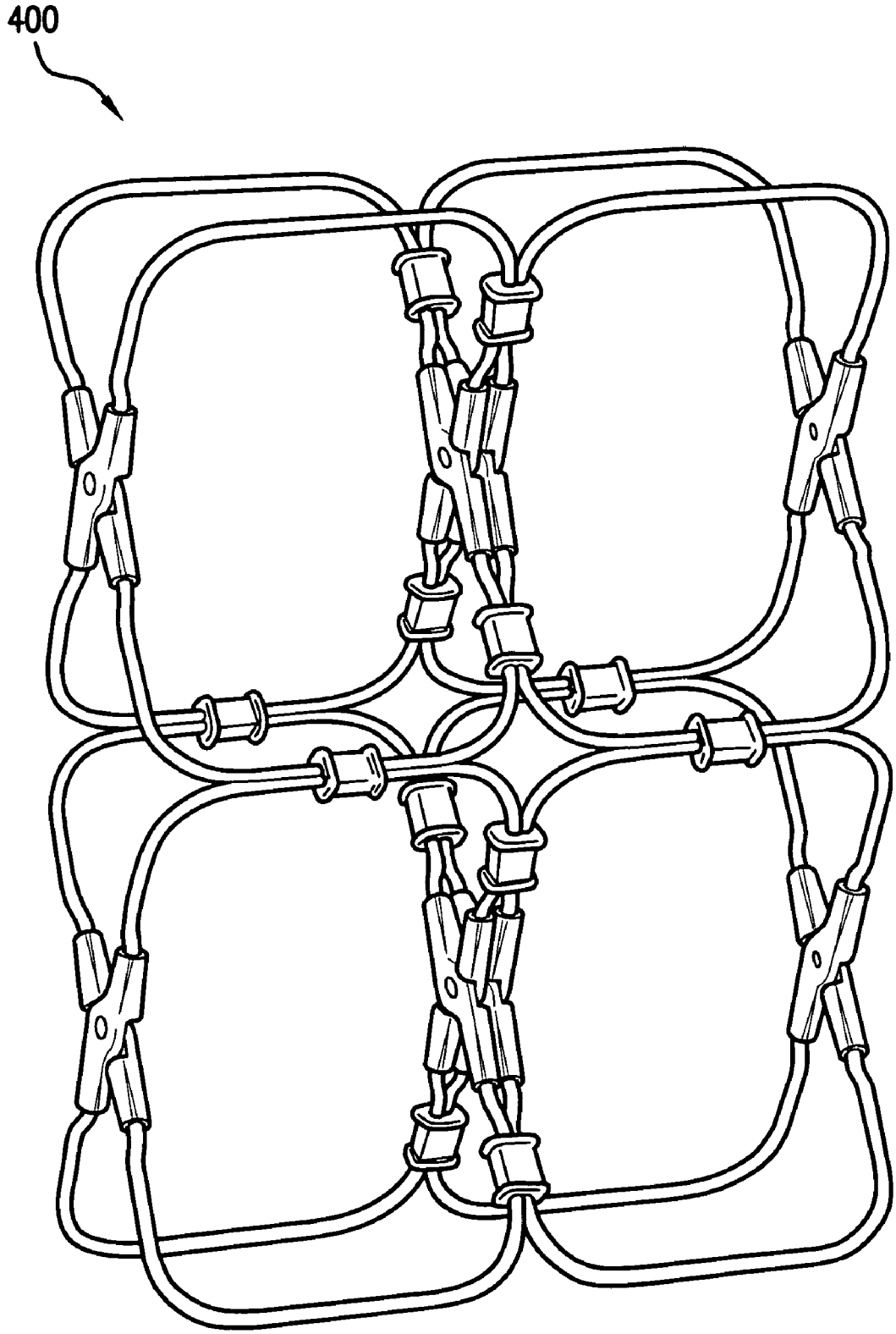
FIG. 14 is a perspective view of the exemplary rack of FIG. 12 in a half-way open configuration.
Figure 15:
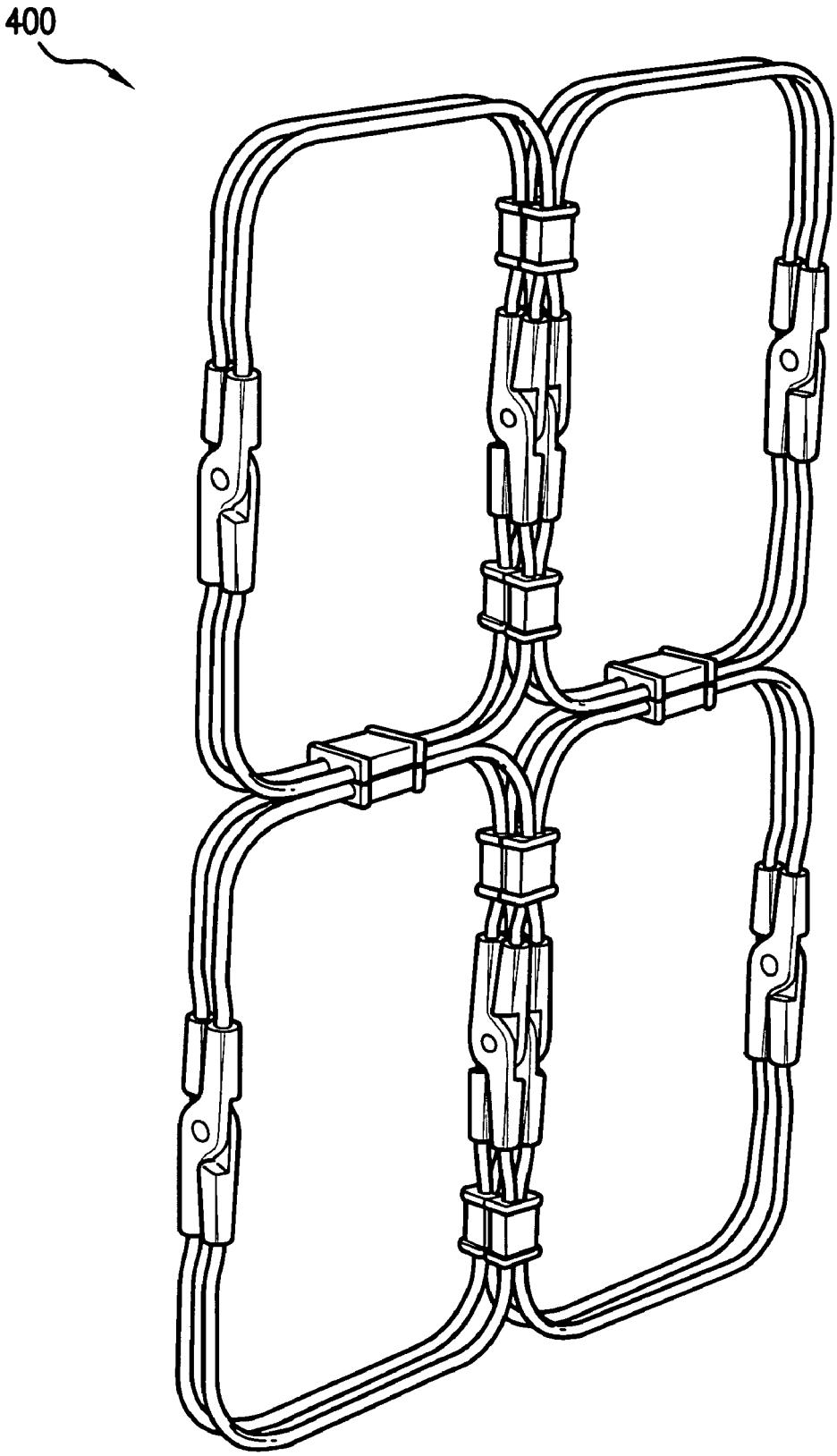
FIG. 15 is a perspective view of the exemplary rack of FIG. 12 folded flat.
Figure 16:
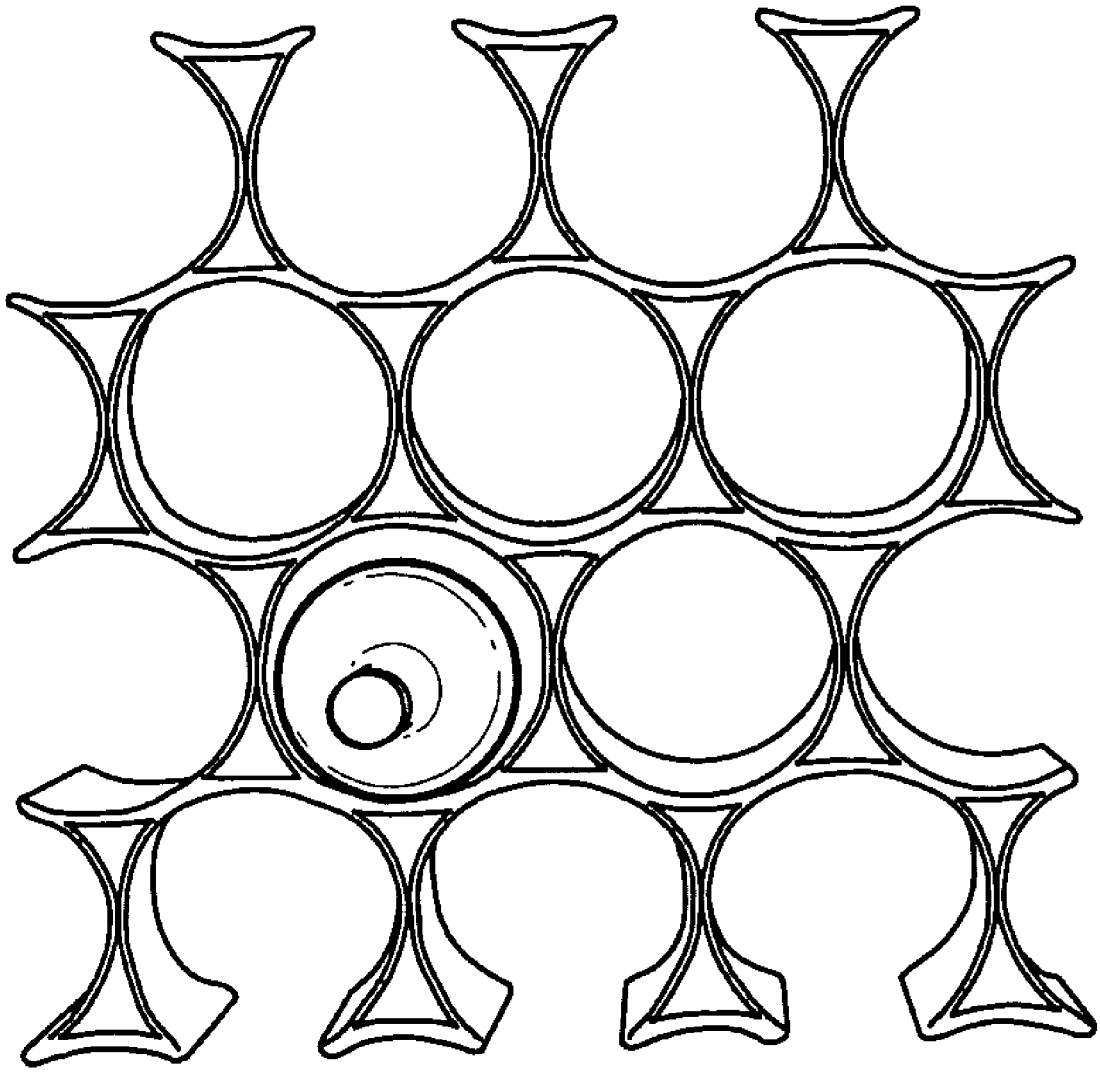
FIG. 16 PRIOR ART
FIG. 16 is a view of a known wine rack.

When not in use, rack 400 may be folded up and stored, with all clips in place, as depicted in FIGS. 14 and 15. The folded flat configuration is also useful for shipping. The advantage of bending wire bends 10 and 40 (FIG. 6) at their ends 12, 14 in a direction out of the X, Y plane so that coupling part 52 lies transverse to the X, Y plane can be seen by comparing FIG. 15 and FIG. 6. This facilitates folding the rack flat for storage or shipment.

Having described preferred embodiments of a novel rack (which are intended to be illustrative and not limiting), it is noted that modifications and variations can be made by persons skilled in the art in light of the above teachings. It is therefore to be understood that changes may be made in the particular embodiments of the invention disclosed which are within the scope of the invention as defined by the appended claims.

Having thus described the invention with the details and particularity required by the patent laws, what is claimed and desired protected by Letters Patent is set forth in the appended claims.

What is claimed is:

1. A rack comprising first and second sections, wherein:

the first section includes a first lower wire bend, a second lower wire bend, a first upper wire bend and a second upper wire bend;

the first section further includes a first pivot coupling into which is received a first end of each of the first and second lower wire bends and into which is received a first end of each of the first and second upper wire bends;

the first section further includes a second pivot coupling into which is received a second end of each of the first and second lower wire bends and into which is received a second end of each of the first and second upper wire bends;

the second section includes a first lower wire bend, a second lower wire bend, a first upper wire bend, a second upper wire bend;

the second section further includes a first pivot coupling into which is received a first end of each of the first and second lower wire bends and into which is received a first end of each of the first and second upper wire bends;

the second section further includes a second pivot coupling into which is received a second end of each of the first and second lower wire bends and into which is received a second end of each of the first and second upper wire bends;

the rack further includes a first resilient clip to hold the first lower wire bend of the second section to the first upper wire bend of the first section; and the rack further includes a second resilient clip to hold the second lower wire bend of the second section to the second upper wire bend of the first section.

2. A rack according to claim 1, wherein the first resilient clip is formed with a channel sized to accommodate two wire bends.

3. A rack according to claim 1, wherein the first resilient clip is formed from a co-molded plastic inside and a rubber outside.

4. A rack comprising first and second sections, wherein:

the first section includes a first lower wire bend, a second lower wire bend, a first upper wire bend and a second upper wire bend;

the first section further includes a first pivot coupling into which is received a first end of each of the first and second lower wire bends and into which is received a first end of each of the first and second upper wire bends;

the first section further includes a second pivot coupling into which is received a second end of each of the first and second lower wire bends and into which is received a second end of each of the first and second upper wire bends;

the second section includes a first lower wire bend, a second lower wire bend, a first upper wire bend, and a second upper wire bend;

the second section further includes a first pivot coupling into which is received a first end of each of the first and second lower wire bends and into which is received a first end of each of the first and second upper wire bends;

the second section further includes a second pivot coupling into which is received a second end of each of the first and second lower wire bends and into which is received a second end of each of the first and second upper wire bends;

the rack further includes a first resilient clip to hold the first lower wire bend of the first section to the first lower wire bend of the second section;

the rack further includes a second resilient clip to hold the second lower wire bend of the first section to the second lower wire bend of the second section;

the rack further includes a third resilient clip to hold the first upper wire bend of the first section to the first upper wire bend of the second section; and the rack further includes a fourth resilient clip to hold the second upper wire bend of the first section to the second upper bend of the second section.

5. A rack according to claim 4, wherein the first resilient clip is formed with a channel sized to accommodate two wire bends.

6. A rack according to claim 4, wherein the first resilient clip is formed from a co-molded plastic inside and a rubber outside.

* * * * *